US009659448B1

(12) United States Patent
Mileski

(10) Patent No.: US 9,659,448 B1
(45) Date of Patent: May 23, 2017

(54) SYSTEM AND METHOD FOR MONETIZING WINNINGS FROM VIRTUAL GAMING

(71) Applicant: Bryan C. Mileski, Lakeville, MN (US)

(72) Inventor: Bryan C. Mileski, Lakeville, MN (US)

( * ) Notice: Subject to any disclaimer, the term of this patent is extended or adjusted under 35 U.S.C. 154(b) by 233 days.

(21) Appl. No.: 14/590,564

(22) Filed: Jan. 6, 2015

Related U.S. Application Data

(60) Provisional application No. 61/924,483, filed on Jan. 7, 2014.

(51) Int. Cl.
*G07F 17/32* (2006.01)

(52) U.S. Cl.
CPC ..... *G07F 17/3244* (2013.01); *G07F 17/3293* (2013.01)

(58) Field of Classification Search
CPC ..... G07F 17/32
See application file for complete search history.

(56) References Cited

U.S. PATENT DOCUMENTS 6,174,237 B1 * 1/2001 Stephenson ..... A63F 13/12 434/322
2006/0205483 A1 * 9/2006 Meyer ..... G06Q 20/06 463/25

* cited by examiner

*Primary Examiner* — Omkar Deodhar
(74) *Attorney, Agent, or Firm* — Dicke, Billig & Czaja, PLLC

(57) ABSTRACT

The present invention provides methods and systems for monetizing virtual poker winnings that include selecting a first plurality of contestants for participation in a virtual poker tournament; conducting the virtual poker tournament, wherein each one of the first plurality of contestants play in the virtual poker tournament using a device operatively coupled to the computer system via an internet connection, and wherein no prizes are awarded in relation to the conducting of the virtual poker tournament; selecting a subset of the first plurality of contestants to form a second plurality of contestants, wherein the second plurality of contestants qualifies for entry to a live poker tournament, and wherein the selecting of the subset of the first plurality of contestants is based at least in part on performance in the virtual poker tournament; conducting the live poker tournament; and awarding prizes to a subset of the second plurality of contestants.

20 Claims, 6 Drawing Sheets

*FIG. 1B*

150

| | TOTAL NUMBER OF ENTRANTS IN STAGE 2 ONLINE CHAMPIONSHIP EVENT | | | | | | | | |
|---|---|---|---|---|---|---|---|---|---|
| FINISHING POSITION AT STAGE 3 LIVE EVENT | 10-29 | 30-49 | 50-99 | 100-199 | 200-299 | 300-399 | 400-499 | 500-749 | 750+ |
| 1 | 50.00% | 40.00% | 30.00% | 30.00% | 27.00% | 26.00% | 25.00% | 25.00% | 25.00% |
| 2 | 30.00% | 25.00% | 20.00% | 20.00% | 18.00% | 17.00% | 16.00% | 15.00% | 14.00% |
| 3 | 20.00% | 15.00% | 12.00% | 10.00% | 9.00% | 8.00% | 8.00% | 7.50% | 7.50% |
| 4 | | 12.00% | 10.00% | 8.00% | 7.00% | 6.00% | 6.00% | 5.50% | 5.00% |
| 5 | | 8.00% | 8.00% | 6.00% | 6.00% | 5.00% | 5.00% | 4.50% | 4.25% |
| 6 | | | 6.00% | 5.00% | 5.00% | 4.00% | 4.00% | 3.50% | 3.50% |
| 7 | | | 5.00% | 4.00% | 4.00% | 3.00% | 3.00% | 3.00% | 2.75% |
| 8 | | | 4.00% | 3.00% | 3.00% | 2.50% | 2.50% | 2.50% | 2.25% |
| 9 | | | 3.00% | 2.25% | 2.00% | 2.00% | 2.00% | 2.00% | 1.75% |
| 10 | | | 2.00% | 1.75% | 1.50% | 1.50% | 1.50% | 1.50% | 1.50% |
| 11-20 | | | | 1.00% | 1.00% | 1.00% | 1.00% | 1.00% | 1.00% |
| 21-30 | | | | | 0.75% | 0.75% | 0.75% | 0.75% | 0.75% |
| 31-40 | | | | | | 0.50% | 0.50% | 0.50% | 0.50% |
| 41-50 | | | | | | 0.25% | 0.25% | 0.25% | 0.25% |
| 51-60 | | | | | | | 0.20% | 0.20% | 0.20% |
| 61-80 | | | | | | | | 0.15% | 0.15% |
| 81-100 | | | | | | | | | 0.125% |

SYSTEM AND METHOD FOR MONETIZING WINNINGS FROM VIRTUAL GAMING

FIELD OF THE INVENTION

The present invention relates to gaming systems and methods, and more particularly to systems and methods for monetizing winnings from virtual poker.

BACKGROUND OF THE INVENTION

The game of poker has enjoyed a resurgence in popularity since the early 2000's when televised poker tournaments such as the World Series of Poker greatly increased exposure to the game. The increased interest in poker has led to larger numbers of entrants and prize pools for poker tournaments and the ability to participate in internet-based poker games and tournaments.

In an internet-based poker game, players generally obtain virtual currency for use in the poker game by transferring legal currency over a financial network in exchange for the virtual currency. Due to gambling regulations, however, only limited jurisdictions allow players to "cash out" or monetize their virtual currency winnings from internet-based poker games. Similarly, gaming companies are very limited in their ability to award prizes to players in an internet-based poker tournament.

U.S. Patent Application Publication 2012/0015715 to Michael Arieh Luxton et al. (hereinafter, "Luxton et al."), titled "VIRTUAL PLAYING CHIPS IN A MULTIUSER ONLINE GAME NETWORK" published Jan. 19, 2012, and is incorporated herein by reference. Luxton et al. describe methods, systems, and computer programs for executing game transactions in an online game to acquire virtual currency. One method includes an operation for detecting a request from a player to purchase virtual currency for use in the online game. Cash or credit is received, in an online transaction, to make the purchase of the virtual currency. The virtual currency of the online game is not redeemable for cash or credit so the virtual currency cannot be considered gambling proceeds. The method further includes an operation for crediting the player with an amount of virtual currency based on the amount of the received cash or credit.

U.S. Patent Application Publication 2014/0006505 to Rama Rao et al. (hereinafter, "Rao et al."), titled "SOCIAL NETWORK DATA ANALYSIS TO GENERATE INCENTIVES FOR ONLINE GAMING" published Jan. 2, 2014, and is incorporated herein by reference. Rao et al. describe systems and methods for processing recommendations of online games to friends of social network. A method for processing recommendations includes identifying a gaming session of a user on an online game provider network, accessing a use profile of the user for the online games of the online game provider network, and accessing a social graph of the user to identify friends of the user and respective friend profiles from the social network. The method further includes producing a recommendation of an online game. The recommendation includes an identification of a target friend of the user and is being provided by examination of the use profile of the user and friend profiles in the social graph. The method includes providing the recommendation to the user. The recommendation also includes an offer incentive to the user to share the recommendation with the target friend.

U.S. Pat. No. 8,128,472 to Charles Clarence Darcy Lyons et al. (hereinafter, "Lyons et al."), titled "POKER TOURNAMENT SYSTEM AND METHOD" issued Mar. 6, 2012, and is incorporated herein by reference. Lyons et al. describe a method of playing a poker style card game tournament includes providing an original table at which a plurality of players can compete in the poker style card game. An entry fee for each of the plurality of players is predetermined. The type of poker style card game in which the players will compete is predetermined as is an event outcome from which a winner is determined from the plurality of players. A mechanism is provided that allows each of the plurality of players to pay the predetermined entry fee to enter the tournament. A forum is also provided that allows each of the plurality of players to compete against one another in the predetermined poker style card game. A point-leader is identified from amongst the plurality of players based on an evaluation of the event outcome. The point-leader is advanced to one or more additional tables and is compensated based on their performance at the one or more additional tables. At least one stakeholder is also compensated based on the performance of the point-leader at the one or more additional tables.

U.S. Pat. No. 8,480,089 to Steven Jeffrey Heller (hereinafter, "Heller"), titled "MULTI-STAGE POKER GAME" issued Jul. 9, 2013, and is incorporated herein by reference. Heller describes a multi-stage poker game or tournament and a method for conducting the same comprising a first stage in which a first plurality of players buy in at a first amount and a second stage in which a second plurality of players buy in at a second, greater amount. The second stage is a continuation of the game, such that non-eliminated players from the first stage may continue playing the game, along with the second plurality of players. The latter group may start the second stage with substantially equal chip counts, but the chip counts for the former group may be unevenly distributed, e.g., in proportion or substantially equal to their chip counts at the end of the first stage. The end of the first stage or beginning of the second stage may be marked by the occurrence of a predetermined trigger, such as a predetermined average chip count being reached or percentage or number of first stage players being eliminated.

U.S. Pat. No. 8,512,117 to Jay S. Walker (hereinafter, "Walker et al."), titled "METHODS AND APPARATUS FOR MANAGING NETWORK LINKED GAMBLING VIDEO GAMES" issued Aug. 20, 2013, and is incorporated herein by reference. Walker et al. describe methods and apparatus for team play in video games. One method includes receiving a request to initiate a gambling game for a player of a first networked machine and joining a second player of a second networked machine to a team. The method further enables transfer of currency between the first and second players of the team using the networked machines during play of the gambling game. The method debits an account of a player using the networked machine that transferred the currency and credits an account of a player that that received the currency. The method further enables wagers in the gambling game using the credited currency, and the method is executed by at least one processor.

There is a need for an improved system and method for monetizing virtual poker winnings.

SUMMARY OF THE INVENTION

In some embodiments, the present invention provides a method for monetizing virtual poker winnings that includes selecting, using a computer system, a first plurality of contestants for participation in a virtual poker tournament; conducting, using the computer system, the virtual poker tournament, wherein each one of the first plurality of contestants play in the virtual poker tournament using a device operatively coupled to the computer system via an internet connection, and wherein no prizes are awarded in relation to the conducting of the virtual poker tournament; selecting, using the computer system, a subset of the first plurality of contestants to form a second plurality of contestants, wherein the second plurality of contestants qualifies for entry to a live poker tournament, and wherein the selecting of the subset of the first plurality of contestants is based at least in part on performance of the first plurality of contestants in the virtual poker tournament; conducting the live poker tournament; and awarding prizes to a subset of the second plurality of contestants based at least in part on performance of the second plurality of contestants in the live poker tournament In some embodiments, the present invention provides a system for monetizing virtual poker winnings that includes a host unit that includes a computer-readable storage medium operatively coupled to a processor, wherein the host unit further includes a virtual-tournament-selection module executed in the processor and configured to select a first plurality of contestants for participation in a virtual poker tournament, a gaming unit executed in the processor and configured to conduct the virtual poker tournament, wherein the first plurality of contestants play in the virtual poker tournament via an internet connection to the host unit, and wherein no prizes are awarded in relation to the virtual poker tournament, and a live-tournament-selection module executed in the processor and configured to select a subset of the first plurality of contestants to form a second plurality of contestants, wherein the second plurality of contestants qualifies for entry to a live poker tournament, wherein the selection of the subset of the first plurality of contestants is based at least in part on performance of the first plurality of contestants in the virtual poker tournament; and wherein prizes are awarded to a subset of the second plurality of contestants in the live poker tournament based at least in part on performance of the second plurality of contestants in the live poker tournament.

In some embodiments, the present invention provides a non-transitory computer-readable medium having instructions stored thereon for causing a suitably programmed computer to execute a method, the method including selecting, using the computer, a first plurality of contestants for participation in a virtual poker tournament; conducting, using the computer, the virtual poker tournament, wherein each one of the first plurality of contestants play in the virtual poker tournament using a device operatively coupled to the computer via an internet connection, and wherein no prizes are awarded in relation to the conducting of the virtual poker tournament; and selecting, using the computer, a subset of the first plurality of contestants to form a second plurality of contestants, wherein the second plurality of contestants qualifies for entry to a live poker tournament, and wherein the selecting of the subset of the first plurality of contestants is based at least in part on performance of the first plurality of contestants in the virtual poker tournament, wherein prizes are awarded to a subset of the second plurality of contestants in the live poker tournament based at least in part on performance of the second plurality of contestants in the live poker tournament.

BRIEF DESCRIPTION OF THE FIGURES

FIG. 1B is a table showing an example payout schedule 150 for Stage 3 (block 130) of FIG. 1A, according to some embodiments.

DETAILED DESCRIPTION OF THE INVENTION

Although the following detailed description contains many specifics for the purpose of illustration, a person of ordinary skill in the art will appreciate that many variations and alterations to the following details are within the scope of the invention. Accordingly, the following preferred embodiments of the invention are set forth without any loss of generality to, and without imposing limitations upon the claimed invention. Further, in the following detailed description of the preferred embodiments, reference is made to the accompanying drawings that form a part hereof, and in which are shown by way of illustration specific embodiments in which the invention may be practiced. It is understood that other embodiments may be utilized and structural changes may be made without departing from the scope of the present invention.

The leading digit(s) of reference numbers appearing in the Figures generally corresponds to the Figure number in which that component is first introduced, such that the same reference number is used throughout to refer to an identical component which appears in multiple Figures. Signals and connections may be referred to by the same reference number or label, and the actual meaning will be clear from its use in the context of the description.

The present invention relates to a gaming system and method. The preferred type of gaming to be utilized in connection with the present invention is poker, but it is contemplated that the present invention can be used with any of the different types of gaming including craps, baccarat, roulette, blackjack, and the like. With regard to poker, it will be understood that the present invention can be utilized in connection with any of the different styles or types of poker, including Texas Hold 'Em, Omaha, Omaha Hi-Lo, Seven Card Stud, Seven Card Hi-Lo; HORSE, and RAZZ. The present invention may also be employed in connection with a variety of other poker type or style card games not listed and can alternatively be employed with other card games.

As used herein, a "virtual" or "online" poker game or poker tournament is a poker game or poker tournament that is facilitated through a plurality of computers and/or electronic devices operatively connected to each other via the internet, via an intranet system, or via any other suitable electronic network.

As used herein, a "live" poker game or poker tournament is a poker game or poker tournament held at a physical location such as a casino.

Figure 1A:
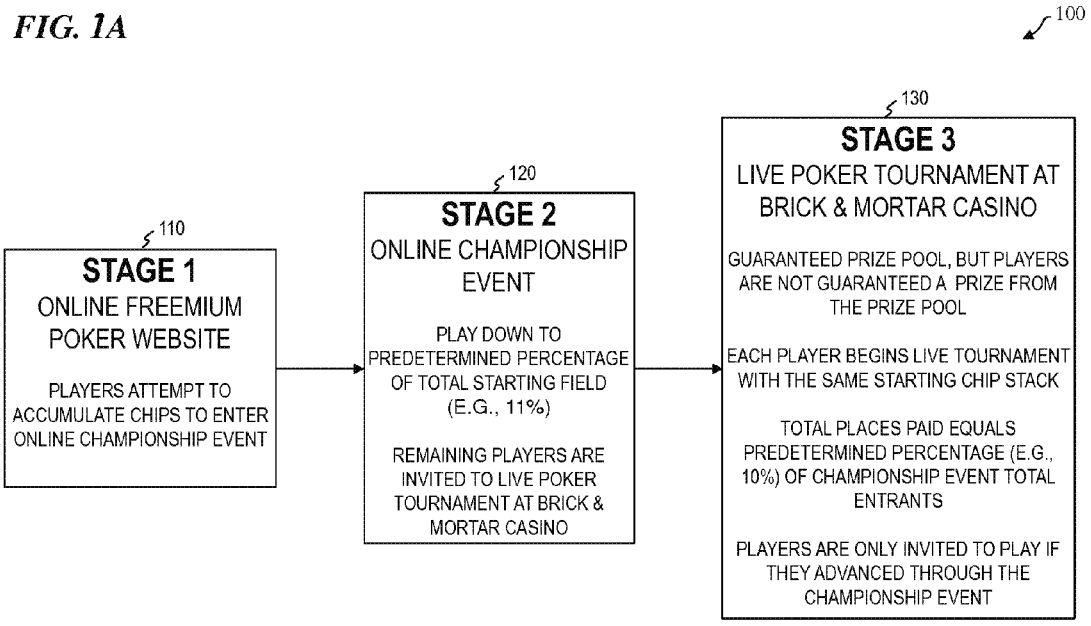
FIG. 1A is a block diagram illustrating a method 100 for monetizing virtual poker winnings.

FIG. 1A is a block diagram illustrating a method 100 for monetizing virtual poker winnings. In some embodiments, at block 110, Stage 1 of method 100 takes place with players playing on an online "Freemium" poker platform. As used herein, "freemium" refers to a pricing strategy by which a proprietary product or service is provided free of charge (e.g., in some embodiments, there is no sign-up or subscription charge for creating and/or using an account on the poker website of the present invention), but money (premium) is charged for advanced features, functionality, or virtual goods (e.g., in some embodiments, other than an initial amount of complimentary chips provided by the poker website, money is charged by the website for purchasing chips to use in playing the poker games on the poker website). In some embodiments, in addition to generating revenue by selling online chips, method 100 generates revenue by selling advertising on the poker website.

In some embodiments, by simply creating an account on the poker website, players receive a certain amount of chips for free. In some embodiments, players use the free chips to play in any type of poker-related game on the website including multi-table tournaments, sit-n-gos, "cash games", and the like. Several types of poker games are available to play including No-Limit Texas Hold 'Em, Omaha, and any other suitable poker games. Tournaments and games of all level chip buy-ins or limits are also offered.

In some embodiments, Freeroll Tournaments (i.e., poker tournaments that have no entry fees) are offered regularly by the poker website each day, allowing players to continue to play for free to earn more chips (e.g., in some embodiments, a player that loses the free chips they receive when signing up for the poker website has the opportunity to earn more chips for free by playing in one or more Freeroll Tournaments). In some embodiments, if a player wants to play in higher-limit games to earn chips more quickly or the player simply wants to replace chips they have lost, the website provides the player an opportunity to buy more chips through virtual currency sales (e.g., in some embodiments, virtual currency transactions take place according to embodiments described by U.S. Patent Application Publication 2012/0015715 to Luxton et al., which is incorporated herein by reference).

In some embodiments, the goal of a player on the poker website provided by the present invention goal is to earn enough chips over a predetermined time period (e.g., several month) to buy in to an online Championship event (e.g., in some embodiments, the level of chips needed to qualify for the online Championship event is set by the poker website at ten million (Ser. No. 10/000,000)). In some embodiments, the chips accumulated by playing poker games on the poker website cannot be redeemed for cash or credit.

In some embodiments, at block 120, Stage 2 of method 100 takes place. In some embodiments, at Stage 2, players that earn the predetermined amount of chips within the predetermined time period (e.g., in some embodiments, 10,000,000 chips within 6 months) and choose to buy in with those chips compete in an online Championship poker tournament. In some embodiments, each player who participates in the online poker tournament start with the same number of chips (in some embodiments, the online poker tournament is a multi-table poker tournament). In some embodiments, starting seats for the online Championship event are determined randomly. In some embodiments, play continues until only a predetermined percentage of players remain (e.g., in some embodiments, 11%). For example, in some embodiments, if there are 10,000 players who enter the online Championship event, then 1,100 players will advance to the live event at a brick & mortar casino (10,000×11%=1,100). In some embodiments, no prizes are paid out online to the players of the online Championship event, and in some such embodiments, players must pay their own transportation and lodging to the live poker tournament. In some embodiments, players are not guaranteed a prize when they get to the live poker tournament.

In some embodiments, the online Championship event ends when the final 11% of the field is reached. In some embodiments, the more players that enter the online Championship event, the higher the guaranteed prize pool at Stage 3 (block 130). For example, in some embodiments, if it is determined that 1,818 players is the threshold to award a prize pool of $10,000,000, then a certain amount will be added to the $10,000,000 prize pool in Stage 3 (block 130) for each player who enters Stage 2 (block 120) above and beyond the 1,818 players.

In some embodiments, at block 130, Stage 3 of method 100 takes place. In some embodiments, at Stage 3, the remaining 11% from Stage 2 are invited to play at a live poker tournament hosted by an actual brick and mortar casino (e.g., in some embodiments, the live poker tournament is held at a casino in Las Vegas, Nev. or Atlantic City, N.J.). In some embodiments, there is a guaranteed prize pool awarded at the live poker tournament (e.g., in some embodiments, the guaranteed prize pool starts at $10,000,000). In some such embodiments, however, players who achieve the top 11% of the online Championship event in Stage 2 are not guaranteed a prize at the live event and must pay their own travel & lodging to attend. In some embodiments, all players invited to the live poker tournament at Stage 3 start the live poker tournament with the exact same starting chip stack so that all players that start the live poker tournament have an equal chance to win. In some embodiments, the live poker tournament starts as a multi-table event and the tables are consolidated as players are eliminated. In some embodiments, the live poker tournament is an elimination-style poker tournament that is played over several days until a winner is reached.

FIG. 1B is a table showing an example payout schedule 150 for Stage 3 (block 130) of FIG. 1A, according to some embodiments. As shown in schedule 150, columns 2-10 represent the total number of entrants into the online Championship event of Stage 2 (block 120). Column 1 represents the finishing position of a player at the Stage 3 (block 130) live poker tournament. The percentages shown in schedule 150 represent the percentage of the total guaranteed prize pool for the live poker tournament that is awarded for a given finishing position at Stage 3 and a given number of total entrants at Stage 2.

In some embodiments, at Stage 3, the host casino awards the prize pool (e.g., in some embodiments, $10,000,000 or more) to a number of players equal to ten percent (10%) of the online Championship event starting field. For example, in some embodiments, if there are 10,000 players that start the online Championship event, then 1,000 players (10,000×10%) will get some level of payout at the live poker tournament in Stage 3 (block 130). Thus, in some such embodiments, if 1,100 players are invited to the live poker tournament, 100 of these players will not get a payout. Although schedule 150 shows a particular payout schedule, the present invention is not so limited and specifically contemplates using any other suitable payout schedule (e.g., in some embodiments, six percent (6%) of the starting field for the online Championship event qualify for the live poker tournament and a number of players at the live poker tournament equal to 5% of the total number of entrants to the online Championship event get a payout at the live poker tournament; in some embodiments, the number of players to get payouts at the live poker tournament is based on any other suitable algorithm).

Figure 2A:
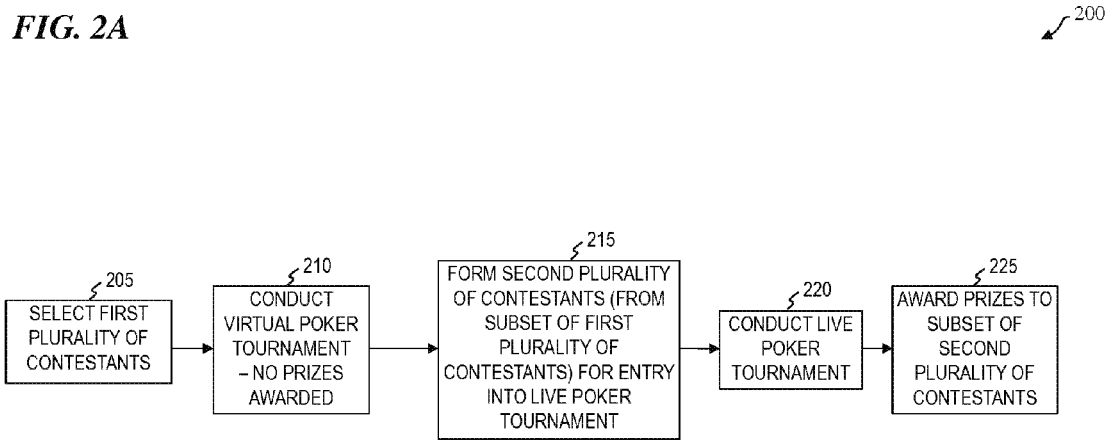
FIG. 2A is a block diagram illustrating a method 200 for monetizing virtual poker winnings.

FIG. 2A is a block diagram illustrating a method 200 for monetizing virtual poker winnings. In some embodiments, method 200 is performed by the systems described below such as systems 300 and 400 of FIG. 3 and FIG. 4, respectively. In some embodiments, at block 205, a first plurality of contestants is selected for participation in a virtual poker tournament (see FIG. 2B for a description of how the first plurality of contestants is selected, according to some embodiments). In some embodiments, the contestants in the virtual poker tournament are provided with an initial amount of complimentary virtual chips that the contestants can use in the virtual poker tournament (e.g., in some embodiments, each one of the first plurality of contestants is provided with 2,500 complimentary virtual chips at the beginning of the virtual poker tournament). In some such embodiments, the first plurality of contestants can purchase additional virtual chips as the virtual poker tournament progresses (in some embodiments, virtual chips are purchased according to embodiments described by U.S. Patent Application Publication 2012/0015715 to Luxton et al., which is incorporated herein by reference). In other such embodiments, the first plurality of contestants cannot purchase additional virtual chips and can only accumulate additional virtual chips through winnings from the virtual poker tournament.

In some embodiments, at block 210, the virtual poker tournament is conducted with the first plurality of contestants. In some embodiments, at the start of the virtual poker tournament, the first plurality of contestants is split into a plurality of virtual tables, and the virtual tables are consolidated as contestants are eliminated from the virtual poker tournament. In some such embodiments, there are 10,000 contestants in the first plurality of contestants and the virtual poker tournament starts with 1,000 virtual tables of 10 contestants each. In some embodiments, no prizes are awarded to any of the contestants in the virtual poker tournament, regardless of their success in the virtual poker tournament. However, in some embodiments, at block 215, a subset of the first plurality of contestants is selected to form a second plurality of contestants that qualify for entry into a live poker tournament. In some such embodiments, the virtual poker tournament is conducted as an elimination tournament, and the subset of contestants selected for entry into the live poker tournament are those contestants who have survived after a predetermined number of the first plurality of contestants have been eliminated from the virtual poker tournament (e.g., in some embodiments, there are 10,000 contestants at the beginning of the virtual poker tournament, and the subset chosen for the live poker tournament are the last 1,100 contestants that remain alive in the virtual poker tournament). In other such embodiments, the virtual poker tournament includes a time limit, and the subset of contestants selected for entry into the live poker tournament are those contestants that are in a predetermined top percentage (e.g., top ten percent) of the first plurality of contestants in terms of virtual chips accumulated within the time limit of the virtual poker tournament.

In some embodiments, at block 220, the live poker tournament is conducted with the second plurality of contestants. In some embodiments, the live poker tournament is held in a jurisdiction that allows cash payouts and other suitable prizes for poker tournaments (e.g., in some embodiments, the live poker tournament is held in a casino located in Las Vegas, Nev.). In some embodiments, before starting the live poker tournament, the identification of each player in the live poker tournament is verified in person, which helps discourage under-age access to the poker website, the virtual poker tournament, and, of course, the live poker tournament.

In some embodiments, the only entrants in the live poker tournament are the second plurality of contestants. In some embodiments, each of the second plurality of contestants is provided a complimentary amount of chips to use in the live poker tournament. In some such embodiments, each one of the second plurality of contestants starts the live poker tournament with the same amount of chips. In other such embodiments, the amount of chips that each contestant starts with in the live poker tournament is proportional to the finishing place of the contestant in the virtual poker tournament (e.g., $1^{st}$, $2^{nd}$, $3^{rd}$, etc.). In some embodiments, contestants in the live poker tournament can purchase more chips as the live tournament progresses. In other embodiments, the contestants in the live poker tournament cannot purchase additional chips and can only accumulate additional chips through winnings from the live poker tournament.

In some embodiments, at block 225, prizes are awarded to a subset of the contestants in the live poker tournament. For example, in some embodiments, the live poker tournament is an elimination tournament, 1,100 players start the live poker tournament, and prizes are awarded to the top 10 finishers in the live poker tournament. In some embodiments, the prize pool from which prizes are awarded for the live poker tournament totals $10 million dollars.

Figure 2B:
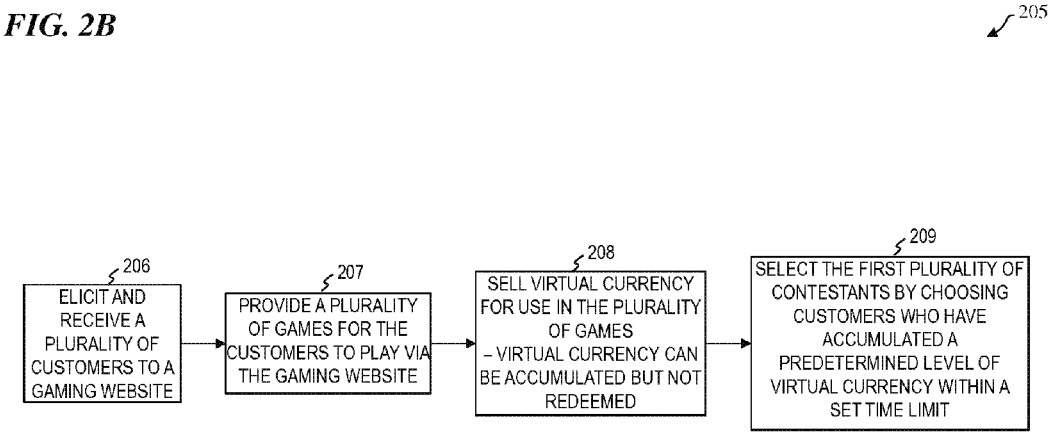
FIG. 2B is a block diagram illustrating a method 205 of selecting the first plurality of contestants for the virtual poker tournament described in FIG. 2A.

FIG. 2B is a block diagram illustrating a method 205 of selecting the first plurality of contestants for the virtual poker tournament described in FIG. 2A. In some embodiments, method 205 is performed by the systems described below such as systems 300 and 400 of FIG. 3 and FIG. 4, respectively. In some embodiments, at block 206, a plurality of customers are elicited and received to a gaming website. In some embodiments, at block 207, the gaming website provides a variety of games that can be played on the website by the customers. In some embodiments, the games include multi-player games. In some embodiments, the games include single-player games. In some embodiments, the games include casino games like craps, blackjack, and the like. In some embodiments, the games include a plurality of poker-style games such as Texas Hold 'Em, Omaha, Seven Card Stud and the like.

In some embodiments, at block 208, virtual currency is offered and sold to customers on the website to be used in the games provided on the website (e.g., in some embodiments, virtual currency transactions take place according to embodiments described by U.S. Patent Application Publication 2012/0015715 to Luxton et al., which is incorporated herein by reference). In some such embodiments, customers can accumulate the virtual currency as winnings from playing the games, but customers cannot redeem the virtual currency for cash or credit.

In some embodiments, at block 209, the first plurality of contestants for the virtual poker tournament are selected by choosing those customers that have accumulated a predetermined level of virtual currency on the website within a set time limit. For example, in some embodiments, a time limit of six (6) months is set, and those customers that have attained ten million points (or any other suitable amount) of virtual currency within the 6-month time frame are selected for participation in the virtual poker tournament. In some embodiments, the time limit is set for three (3) months. In some embodiments, the time limit is set at any other suitable value. Although participants in the virtual poker tournament are not awarded prizes, customers are nonetheless given incentive to play games on the gaming website in order to qualify for the virtual poker tournament because the customers who qualify for the virtual tournament can play their way into the live poker tournament and thus possibly win prizes at the live poker tournament. This arrangement provides online poker players a way to monetize online poker winnings regardless of the jurisdiction in which they live because the potential for prizes does not exist unless and until the poker player makes it to the live poker tournament.

Figure 3:
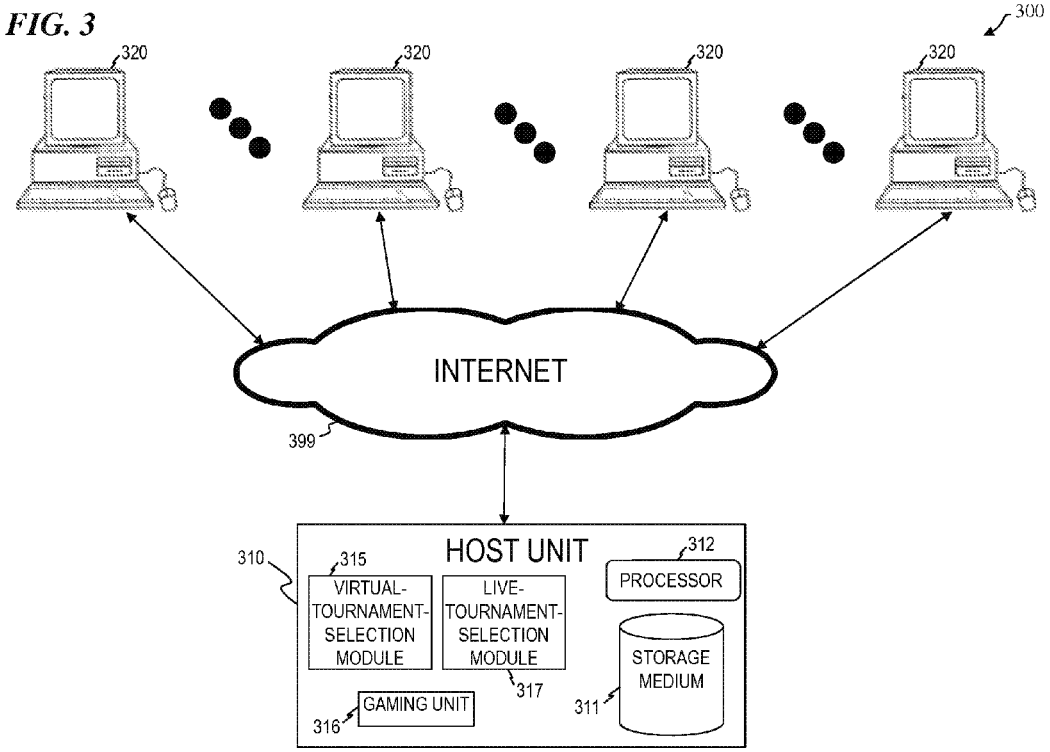
FIG. 3 is a schematic diagram of a system 300 that is used, in some embodiments, to perform the methods of the present invention.

FIG. 3 is a schematic diagram of a system 300 that is used, in some embodiments, to perform the methods of the present invention. In some embodiments, system 300 includes a plurality of customer devices 320 that are connected to each other and a host unit 310 via the internet 399. In some embodiments, customer devices 320 include desktop computers, laptop computers, tablets, smartphones, or any other suitable electronic device. In some embodiments, host unit 310 includes a computer-readable storage medium 311 operatively coupled to a processor 312. In some embodiments, host unit 310 further includes a virtual-tournament-selection module 315 executed in processor 312 and configured to select a first plurality of contestants for participation in the virtual poker tournament, a gaming unit 316 executed in processor 312 and configured to conduct the virtual poker tournament, wherein the first plurality of contestants play in the virtual poker tournament via customer devices 320, and wherein no prizes are awarded in relation to the virtual poker tournament, and a live-tournament-selection module 317 executed in processor 312 and configured to select a subset of the first plurality of contestants to form a second plurality of contestants, wherein the second plurality of contestants qualifies for entry to a live poker tournament, wherein the selection of the subset of the first plurality of contestants is based at least in part on performance of the first plurality of contestants in the virtual poker tournament; and wherein prizes are awarded to a subset of the second plurality of contestants in the live poker tournament based at least in part on performance of the second plurality of contestants in the live poker tournament. In some embodiments, gaming unit 316 of host unit 310 is further configured to provide the plurality of games on the gaming website that customers play in order to qualify for the virtual poker tournament.

Figure 4:
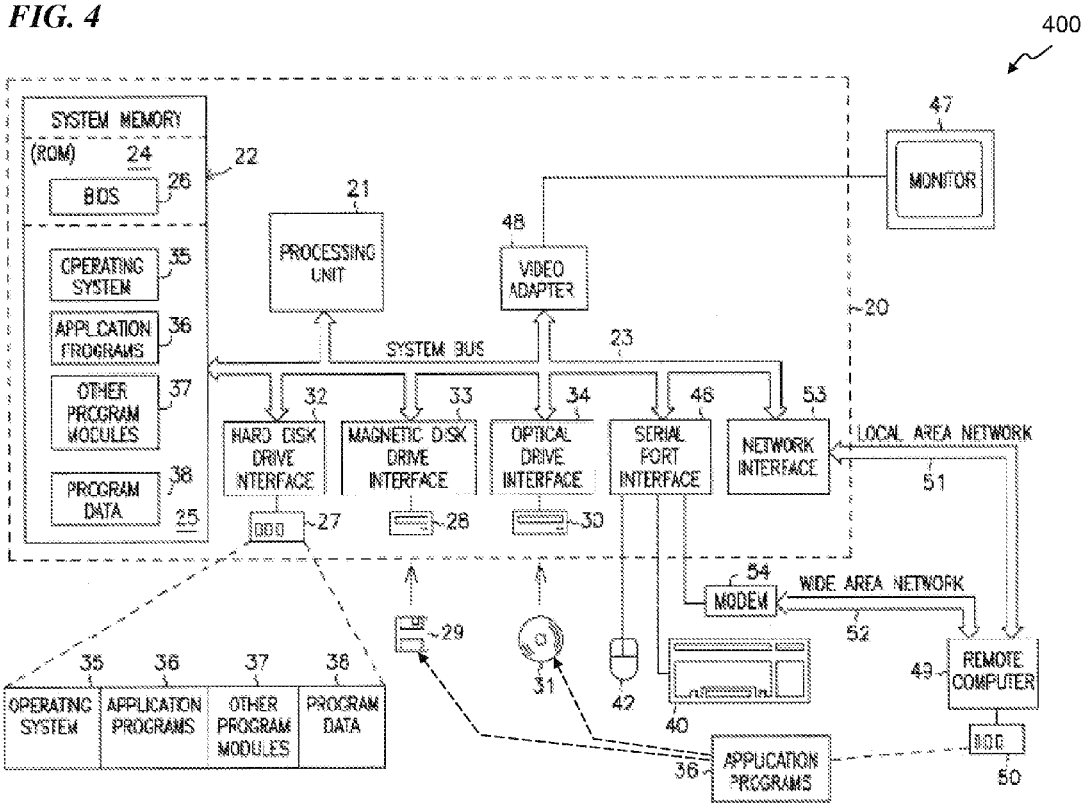
FIG. 4 is an overview diagram of a hardware- and operating-environment (or system) 400 that is used, in some embodiments, to perform the methods of the present invention.

FIG. 4 is an overview diagram of a hardware- and operating-environment (or system) 400 that is used, in some embodiments, to perform the methods of the present invention. The description of FIG. 4 is intended to provide a brief, general description of suitable computer hardware and a suitable computing environment in conjunction with which the invention may be implemented. In some embodiments, the invention is described in the general context of computer-executable instructions, such as program modules, that are stored on computer-readable media and that are executed by a computer, such as a microprocessor residing in a personal computer. Generally, program modules include routines, programs, objects, components, data structures, and the like, that perform particular tasks or implement particular abstract data types.

Moreover, those skilled in the art will appreciate that the invention may be practiced with other computer system configurations, including hand-held devices, multiprocessor systems, microprocessor-based or programmable consumer electronics, network PCS, minicomputers, mainframe computers, and the like. The invention may also be practiced in distributed computer environments where tasks are performed by input-output remote processing devices that are linked through a communications network. In a distributed computing environment, program modules may be located in both local and remote memory storage devices.

In some embodiments, a hardware and operating environment applicable to any of the host unit 310 and/or customer devices 320 shown in FIG. 3 is provided. In some embodiments, system 400 includes a user-control console computer 20 that is programmable. In some embodiments, application programs 36 stored on a computer-readable storage device (e.g., optical disk 31 (CDROM, DVD, Blu-ray Disc™ (BD), or the like), magnetic or FLASH storage device 29 (e.g., floppy disk, thumb drive, SDHC™ (Secure-Data High-Capacity) memory card or the like), and/or a storage device 50 connected to a remote computer 49 (e.g., in some embodiments, customer devices 320 of FIG. 3) that connects to computer 20 across a local-area network 51 or a wide-area network 52 such as the internet) contain instructions and/or control structures (such as look-up tables, control parameters, databases and the like) that are processed and/or transmitted to system components 410 to control their operation by methods of the present invention described herein. In some embodiments, the applications programs 36 are partially executed in the computer 20.

As shown in FIG. 4, in some embodiments, the hardware- and operating-environment includes user-control console computer 20, or a server 20, including a processing unit 21, a system memory 22, and a system bus 23 that operatively couples various system components including the system memory 22 to the processing unit 21. In some embodiments, there may be only one, or in other embodiments, there may be more than one processing unit 21, such that the processor of computer 20 comprises a single central-processing unit (CPU), or a plurality of processing units, commonly referred to as a multi-processor or parallel-processing environment. In various embodiments, computer 20 may be implemented using a conventional computer, a distributed computer, or any other type of computer including those embedded in cell phones, personal-data-assistant devices or other form factors. For example, in some embodiments, computer 20 is implemented as any suitable computing device such as a desktop computer or a network of such computers, a laptop computer (e.g., a Macbook®), a tablet computer (e.g., an iPad®), a music and/or video-player computer (e.g., an iPod Touch®), a cell phone computer (e.g., an iPhone®), a smart television (one that can stream video programming from the internet), a video-streaming device (e.g., a Roku® or an AppleTV®) that obtains content from the internet and outputs the content to a conventional high-definition TV), a computer/MP3-player/CD-player/GPS/phone system in an automobile or other vehicle, or any other suitable personal-computing (PC) platform (although several Apple® products are listed as typical examples here since most persons of skill in the art can identify the type of device by analogy to such Apple® products, the products of any other manufacturer may be substituted).

The system bus 23 can be any of several types of bus structures including a memory bus or memory controller, a peripheral bus, and a local bus using any of a variety of bus architectures. The system memory can also be referred to as simply the memory, and includes read-only memory (ROM) 24 and random-access memory (RAM) 25. A basic input/output system (BIOS) 26, containing the basic routines that help to transfer information between elements within the computer (or server) 20, such as during start-up, may be stored in ROM 24. The computer 20 further includes a hard disk drive 27 for reading from and writing to a magnetic hard disk, a removable-media drive or FLASH controller 28 for reading from or writing to a removable magnetic floppy-disk or FLASH storage device 29, and an optical disk drive 30 for reading from or writing to a removable optical disk 31 (such as a CDROM, DVD, Blu-ray Disc™ (BD) or other optical media).

The hard disk drive 27, magnetic disk drive 28, and optical disk drive 30 couple with a hard disk drive interface 32, a magnetic disk drive interface 33, and an optical disk drive interface 34, respectively. The drives and their associated computer-readable media provide non-volatile, non-ephemeral storage of computer-readable instructions, data structures, program modules and other data for the computer 20. It should be appreciated by those skilled in the art that any type of computer-readable media which can store data that is accessible by a computer, such as magnetic cassettes, FLASH memory cards, digital video disks, Bernoulli cartridges, random-access memories (RAMs), read-only memories (ROMs), redundant arrays of independent disks (e.g., RAID storage devices) and the like, can be used in the exemplary operating environment.

A plurality of program modules that implement the methods of the present invention (e.g., virtual-tournament selection module 315 of FIG. 3) can be stored on the hard disk, magnetic or FLASH storage device 29, optical disk 31, ROM 24, or RAM 25, including an operating system 35, one or more application programs 36, other program modules 37, and program data 38. A plug-in program containing a security transmission engine for the present invention can be resident on any one, or on a plurality of these computer-readable media.

In some embodiments, a user enters commands into the computer 20 through input devices such as a keyboard 40, pointing device 42 or other suitable devices. These input devices are often connected to the processing unit 21 through a serial port interface 46 that is coupled to the system bus 23, but can be connected by other interfaces, such as a parallel port, game port, or a universal serial bus (USB); a monitor 47 or other type of display device can also be connected to the system bus 23 via an interface, such as a video adapter 48. The monitor 47 can display a graphical user interface for the audiologist and/or user. In addition to the monitor 47, computers typically include other peripheral output devices (not shown), such as speakers and printers.

In some embodiments, computer 20 operates in a networked environment using logical connections to one or more remote computers or servers, such as remote computer 49. These logical connections are achieved by a communication device coupled to or a part of the computer 20; the invention is not limited to a particular type of communications device. The remote computer 49 can be another computer, a server, a router, a network PC, a client, a peer device or other common network node, and typically includes many or all of the elements described above relative to the computer 20, although only memory storage device 50 and application programs 36 have been illustrated in FIG. 4. The logical connections depicted in FIG. 4 include local-area network (LAN) 51 and wide-area network (WAN) 52. Such networking environments are commonplace in office networks, enterprise-wide computer networks, intranets and the Internet, which are all types of networks.

When used in a local-area networking (LAN) environment, the computer 20 is connected to the LAN 51 through a network interface, modem or adapter 53, which is one type of communications device. When used in a wide-area networking (WAN) environment such as the internet, the computer 20 typically includes an adaptor or modem 54 (a type of communications device), or any other type of communications device, e.g., a wireless transceiver, for establishing communications over the wide area network 52, such as the internet. The modem 54, which may be internal or external, is connected to the system bus 23 via the serial port interface 46. In a networked environment, program modules depicted relative to the personal computer 20, or portions thereof, can be stored in the remote memory storage device 50 of remote computer (or server) 49 and accessed over the internet or other communications means. Note that the transitory signals on the internet may move stored program code from a non-transitory storage medium at one location to a computer that executes the code at another location by the signals on one or more networks. The program instructions and data structures obtained from a network or the internet are not "stored" on the network itself, but are stored in non-transitory storage media that may be connected to the internet from time to time for access. It is appreciated that the network connections shown are exemplary, and in some embodiments, other means of, and communications devices for, establishing a communications link between the computers may be used including hybrid fiber-coax connections, T1-T3 lines, DSL's, OC-3 and/or OC-12, TCP/IP, microwave, WAP (wireless application protocol), and all other electronic media through standard switches, routers, outlets and power lines, as the same are known and understood by one of ordinary skill in the art.

The hardware and operating environment in conjunction with which embodiments of the invention may be practiced has been described. The computer 20 in conjunction with which embodiments of the invention can be practiced can be a conventional computer, a distributed computer, or any other type of computer; the invention is not so limited. Such a computer 20 typically includes one or more processing units as its processor, and a computer-readable medium such as a memory. The computer 20 can also include a communications device such as a network adapter or a modem, so that it is able to communicatively couple to other computers, servers, or devices. In some embodiments, one or more parts of system 400 elicits and receives input from a user, and based on the input, modifies, adjusts or executes one or more of the methods of the present invention as described herein.

In some embodiments, the present invention provides a method for monetizing virtual poker winnings that includes selecting, using a computer system, a first plurality of contestants for participation in a virtual poker tournament; conducting, using the computer system, the virtual poker tournament, wherein each one of the first plurality of contestants play in the virtual poker tournament using a device operatively coupled to the computer system via an internet connection, and wherein no prizes are awarded in relation to the conducting of the virtual poker tournament; selecting, using the computer system, a subset of the first plurality of contestants to form a second plurality of contestants, wherein the second plurality of contestants qualifies for entry to a live poker tournament, and wherein the selecting of the subset of the first plurality of contestants is based at least in part on performance of the first plurality of contestants in the virtual poker tournament; conducting the live poker tournament; and awarding prizes to a subset of the second plurality of contestants based at least in part on performance of the second plurality of contestants in the live poker tournament.

In some embodiments of the method, the selecting of the first plurality of contestants includes eliciting and receiving a plurality of customers to a gaming website controlled by the computer system, wherein the gaming website includes a plurality of online poker-style games that can be played by the plurality of customers; selling virtual currency, via the gaming website, to the plurality of customers for use in the plurality of online poker-style games, wherein the virtual currency can be accumulated as winnings from the plurality of online poker-style games, but the virtual currency is not redeemable for cash or credit; and setting a time limit for accumulating a predetermined level of the virtual currency, wherein the first plurality of contestants are those customers of the plurality of customers who have attained the predetermined level of virtual currency within the time limit.

In some embodiments, the method further includes providing each one of the first plurality of contestants a complimentary first amount of virtual chips for use in the virtual poker tournament. In some embodiments, the method further includes providing each one of the first plurality of contestants a complimentary first amount of virtual chips for use in the virtual poker tournament, wherein each one of the first plurality of contestants start the virtual poker tournament with only the first amount of chips.

In some embodiments of the method, the prizes awarded to the subset of the second plurality of contestants include cash payouts. In some embodiments, entrants in the live poker tournament consist of no more than the second plurality of contestants.

In some embodiments, the method further includes providing each one of the second plurality of contestants a second amount of chips for use in the live poker tournament. In some embodiments, the method further includes providing each one of the second plurality of contestants a second amount of chips for use in the live poker tournament, wherein each one of the second plurality of contestants start the live poker tournament with only the second amount of chips.

In some embodiments, the method further includes eliciting and receiving, from at least one of the first plurality of contestants and into the computer system, payment for purchasing virtual chips for use in the virtual poker tournament; and electronically delivering, using the computer system, the purchased virtual chips to the at least one of the first plurality of contestants based on the received payment. In some embodiments, the conducting of the live poker tournament includes locating the live poker tournament in a jurisdiction that allows cash payouts for poker tournaments.

In some embodiments of the method, the conducting of the virtual poker tournament includes instituting a survival-mode format for the virtual poker tournament, wherein the selecting of the subset of the first plurality of contestants includes choosing contestants of the first plurality of contestants that have survived after a predetermined number of the first plurality of contestants have been eliminated. In some embodiments, the virtual poker tournament includes a time limit, wherein the selecting includes choosing contestants of the first plurality of contestants that are in a top ten percent of the first plurality of contestants in terms of virtual chips accumulated within the time limit of the virtual poker tournament.

In some embodiments, the present invention provides a system for monetizing virtual poker winnings that includes a host unit that includes a computer-readable storage medium operatively coupled to a processor, wherein the host unit further includes a virtual-tournament-selection module executed in the processor and configured to select a first plurality of contestants for participation in a virtual poker tournament, a gaming unit executed in the processor and configured to conduct the virtual poker tournament, wherein the first plurality of contestants play in the virtual poker tournament via an internet connection to the host unit, and wherein no prizes are awarded in relation to the virtual poker tournament, and a live-tournament-selection module executed in the processor and configured to select a subset of the first plurality of contestants to form a second plurality of contestants, wherein the second plurality of contestants qualifies for entry to a live poker tournament, wherein the selection of the subset of the first plurality of contestants is based at least in part on performance of the first plurality of contestants in the virtual poker tournament; and wherein prizes are awarded to a subset of the second plurality of contestants in the live poker tournament based at least in part on performance of the second plurality of contestants in the live poker tournament.

In some embodiments of the system, the host unit controls a gaming website configured to elicit and receive a plurality of customers to play at least one of a plurality of online poker-style games provided on the website, wherein the plurality of customers purchase virtual currency via the gaming website to use in the plurality of online poker-style games, wherein the virtual currency can be accumulated as winnings from the plurality of online poker-style games, but the virtual currency is not redeemable for cash or credit, wherein the virtual-tournament-selection module further includes a timer configured to set a time limit for accumulation of a predetermined level of the virtual currency, and wherein the first plurality of contestants are those customers of the plurality of customers who have attained the predetermined level of virtual currency within the time limit.

In some embodiments of the system, the gaming unit is further configured to provide each one of the first plurality of contestants a complimentary first amount of virtual chips for use in the virtual poker tournament. In some embodiments, the prizes awarded to the subset of the second plurality of contestants include cash payouts. In some embodiments, entrants in the live poker tournament consist of no more than the second plurality of contestants. In some embodiments, each one of the second plurality of contestants is provided a second amount of chips for use in the live poker tournament. In some embodiments, each one of the second plurality of contestants is provided a second amount of chips for use in the live poker tournament, wherein each one of the second plurality of contestants start the live poker tournament with only the second amount of chips.

In some embodiments of the system, the host unit further includes a transaction unit configured to elicit and receive, from at least one of the first plurality of contestants, payment to purchase virtual chips for use in the virtual poker tournament, and electronically deliver the purchased virtual chips to the at least one of the first plurality of contestants based on the received payment. In some embodiments, the live poker tournament is held in a jurisdiction that allows cash payouts for poker tournaments.

In some embodiments of the system, the virtual poker tournament is conducted in a survival-mode format, wherein formation of the second plurality of contestants includes selection, by the selection module, of contestants of the first plurality of contestants that have survived after a predetermined number of the first plurality of contestants have been eliminated. In some embodiments, the virtual poker tournament includes a time limit, and wherein formation of the second plurality of contestants includes selection, by the selection module, of contestants of the first plurality of contestants that are in a top ten percent of the first plurality of contestants in terms of virtual chips accumulated within the time limit of the virtual poker tournament.

In some embodiments, the present invention provides a non-transitory computer-readable medium having instructions stored thereon for causing a suitably programmed computer to execute a method, the method including selecting, using the computer, a first plurality of contestants for participation in a virtual poker tournament; conducting, using the computer, the virtual poker tournament, wherein each one of the first plurality of contestants play in the virtual poker tournament using a device operatively coupled to the computer via an internet connection, and wherein no prizes are awarded in relation to the conducting of the virtual poker tournament; and selecting, using the computer, a subset of the first plurality of contestants to form a second plurality of contestants, wherein the second plurality of contestants qualifies for entry to a live poker tournament, and wherein the selecting of the subset of the first plurality of contestants is based at least in part on performance of the first plurality of contestants in the virtual poker tournament, wherein prizes are awarded to a subset of the second plurality of contestants in the live poker tournament based at least in part on performance of the second plurality of contestants in the live poker tournament.

In some embodiments, the non-transitory computer-readable medium further includes instructions such that the method further includes providing each one of the first plurality of contestants a complimentary first amount of virtual chips for use in the virtual poker tournament. In some embodiments, the non-transitory computer-readable medium further includes instructions such that the method further includes eliciting and receiving, from at least one of the first plurality of contestants and into the computer system, payment for purchasing virtual chips for use in the virtual poker tournament; and electronically delivering, using the computer system, the purchased virtual chips to the at least one of the first plurality of contestants based on the received payment.

In some embodiments, the non-transitory computer-readable medium further includes instructions such that the conducting of the virtual poker tournament includes instituting a survival-mode format for the virtual poker tournament, wherein the selecting includes choosing contestants of the first plurality of contestants that have survived after a predetermined number of the first plurality of contestants have been eliminated. In some embodiments, non-transitory computer-readable medium further includes instructions such that the virtual poker tournament includes a time limit, and wherein the selecting includes choosing contestants of the first plurality of contestants that are in a top ten percent of the first plurality of contestants in terms of virtual chips accumulated within the time limit of the virtual poker tournament. In some embodiments, the non-transitory computer-readable medium further includes instructions such that conducting of the virtual poker tournament includes using Texas Hold 'Em rules for the virtual poker tournament.

In some embodiments, the non-transitory computer-readable medium further includes instructions such that the selecting of the first plurality of contestants includes eliciting and receiving a plurality of customers to a gaming website controlled by the computer, wherein the gaming website includes a plurality of online poker-style games that can be played by the plurality of customers; selling virtual currency, via the gaming website, to the plurality of customers for use in the plurality of online poker-style games, wherein the virtual currency can be accumulated as winnings from the plurality of online poker-style games, but the virtual currency is not redeemable for cash or credit; and setting a time limit for accumulating a predetermined level of the virtual currency, wherein the first plurality of contestants are those customers of the plurality of customers who have attained the predetermined level of virtual currency within the time limit.

In some embodiments, the present invention provides a method for monetizing virtual poker winnings that includes eliciting and receiving, into a computer system, a first plurality of contestants for a virtual poker tournament; conducting, using the computer system, the virtual poker tournament, wherein each one of the first plurality of contestants play in the virtual poker tournament via a device operatively coupled to the computer system via an internet connection, and wherein no prizes are awarded in relation to the conducting of the virtual poker tournament; selecting, using the computer system, a subset of the first plurality of contestants to form a second plurality of contestants, wherein the second plurality of contestants qualifies for entry to a live poker tournament, and wherein the selecting is based at least in part on performance of the first plurality of contestants in the virtual poker tournament; conducting the live poker tournament; and awarding prizes to a subset of the second plurality of contestants based at least in part on performance of the second plurality of contestants in the live poker tournament.

In some embodiments, the present invention provides a system for monetizing virtual poker winnings that includes a host unit that includes a computer-readable storage medium operatively coupled to a processor, wherein the host unit further includes a receiver configured to elicit and receive a first plurality of contestants for a virtual poker tournament, a gaming unit executed in the processor and configured to conduct the virtual poker tournament, wherein the first plurality of contestants play in the virtual poker tournament via an internet connection to the host unit, and wherein no prizes are awarded in relation to the virtual poker tournament, and a selection module executed in the processor and configured to select a subset of the first plurality of contestants to form a second plurality of contestants, wherein the second plurality of contestants qualifies for entry to a live poker tournament, wherein the selection of the subset of the first plurality of contestants is based at least in part on performance of the first plurality of contestants in the virtual poker tournament; and wherein prizes are awarded to a subset of the second plurality of contestants in the live poker tournament based at least in part on performance of the second plurality of contestants in the live poker tournament.

In some embodiments, the present invention provides a non-transitory computer-readable medium having instructions stored thereon for causing a suitably programmed computer to execute a method, the method including eliciting and receiving, into the computer, a first plurality of contestants for a virtual poker tournament; conducting, using the computer, the virtual poker tournament, wherein each one of the first plurality of contestants play in the virtual poker tournament via a device operatively coupled to the computer via an internet connection, and wherein no prizes are awarded in relation to the conducting of the virtual poker tournament; and selecting, using the computer, a subset of the first plurality of contestants to form a second plurality of contestants, wherein the second plurality of contestants qualifies for entry to a live poker tournament, and wherein the selecting is based at least in part on performance of the first plurality of contestants in the virtual poker tournament, wherein prizes are awarded to a subset of the second plurality of contestants in the live poker tournament based at least in part on performance of the second plurality of contestants in the live poker tournament.

It is specifically contemplated that the present invention includes embodiments having combinations and subcombinations of the various embodiments and features that are individually described herein (i.e., rather than listing every combinatorial of the elements, this specification includes descriptions of representative embodiments and contemplates embodiments that include some of the features from one embodiment combined with some of the features of another embodiment, including embodiments that include some of the features from one embodiment combined with some of the features of embodiments described in the patents and application publications incorporated by reference in the present application). Further, some embodiments include fewer than all the components described as part of any one of the embodiments described herein.

It is to be understood that the above description is intended to be illustrative, and not restrictive. Although numerous characteristics and advantages of various embodiments as described herein have been set forth in the foregoing description, together with details of the structure and function of various embodiments, many other embodiments and changes to details will be apparent to those of skill in the art upon reviewing the above description. The scope of the invention should be, therefore, determined with reference to the appended claims, along with the full scope of equivalents to which such claims are entitled. In the appended claims, the terms "including" and "in which" are used as the plain-English equivalents of the respective terms "comprising" and "wherein," respectively. Moreover, the terms "first," "second," and "third," etc., are used merely as labels, and are not intended to impose numerical requirements on their objects.

What is claimed is:

1. A method for monetizing virtual gaming winnings comprising:

eliciting and receiving a plurality of customers to a gaming website controlled by a computer system;

selecting, using the computer system, a first plurality of contestants from the plurality of customers for participation in a virtual gaming tournament;

conducting, using the computer system, the virtual gaming tournament, wherein each one of the first plurality of contestants play in the virtual gaming tournament using a device operatively coupled to the computer system via an internet connection, and wherein no prizes are awarded in relation to the conducting of the virtual gaming tournament;

selecting, using the computer system, a subset of the first plurality of contestants to form a second plurality of contestants, wherein the second plurality of contestants qualifies for entry to a live gaming tournament to be held at a physical location, and wherein the selecting of the subset of the first plurality of contestants is based at least in part on performance of the first plurality of contestants in the virtual gaming tournament;

conducting the live gaming tournament at the physical location as a competition between only those contestants of the second plurality of contestants physically present in the physical location at a start of the live gaming tournament; and awarding prizes to a subset of the second plurality of contestants based at least in part on performance of the second plurality of contestants in the live gaming tournament.

2. The method of claim 1, wherein the gaming website includes a plurality of online poker-style games that can be played by the plurality of customer, and further wherein the selecting of the first plurality of contestants includes:

selling virtual currency, via the gaming web site, to the plurality of customers for use in the plurality of online poker-style games, wherein the virtual currency can be accumulated as winnings from the plurality of online poker-style games, but the virtual currency is not redeemable for cash or credit; and setting a time limit for accumulating a predetermined level of the virtual currency, wherein the first plurality of contestants are those customers of the plurality of customers who have attained the predetermined level of virtual currency within the time limit.

3. The method of claim 1, further comprising providing each one of the first plurality of contestants a complimentary first amount of virtual chips for use in the virtual gaming tournament.

4. The method of claim 1, wherein entrants in the live gaming tournament consist of no more than the second plurality of contestants.

5. The method of claim 1, further comprising providing each one of the second plurality of contestants a second amount of chips for use in the live gaming tournament, wherein each one of the second plurality of contestants start the live gaming tournament with only the second amount of chips.

6. The method of claim 1, further comprising:

eliciting and receiving, from at least one of the first plurality of contestants and into the computer system, payment for purchasing virtual chips for use in the virtual gaming tournament; and electronically delivering, using the computer system, the purchased virtual chips to the at least one of the first plurality of contestants based on the received payment.

7. The method of claim 1, wherein the conducting of the virtual gaming tournament includes instituting a survival-mode format for the virtual gaming tournament, wherein the selecting of the subset of the first plurality of contestants includes choosing contestants of the first plurality of contestants that have survived after a predetermined number of the first plurality of contestants have been eliminated.

8. A system for monetizing virtual gaming winnings comprising:

a host unit that includes a computer-readable storage medium operatively coupled to a processor, wherein the host unit further includes:

a virtual-tournament-selection module executed in the processor and configured to select a first plurality of contestants for participation in a virtual gaming tournament, a gaming unit executed in the processor and configured to:

elicit and receive a plurality of customers to a gaming website, conduct the virtual gaming tournament, wherein the first plurality of contestants play in the virtual gaming tournament via an internet connection to the host unit, and wherein no prizes are awarded in relation to the virtual gaming tournament, wherein the virtual-tournament-selection module is configured to select the first plurality of contestants from the plurality of customers, and a live-tournament-selection module executed in the processor and configured to select a subset of the first plurality of contestants to form a second plurality of contestants, wherein the second plurality of contestants qualifies for entry to a live gaming tournament to be held at a physical location amongst only those contestants physically present in the physical location at a start of the live gaming tournament, wherein the selection of the subset of the first plurality of contestants is based at least in part on performance of the first plurality of contestants in the virtual gaming tournament; and wherein prizes are awarded to a subset of the second plurality of contestants in the live gaming tournament based at least in part on performance of the second plurality of contestants in the live gaming tournament.

9. The system of claim 8, wherein the gaming unit is further configured to provide each one of the first plurality of contestants a complimentary first amount of virtual chips for use in the virtual gaming tournament.

10. The system of claim 8, wherein entrants in the live gaming tournament consist of no more than the second plurality of contestants.

11. The system of claim 8, wherein each one of the second plurality of contestants is provided a second amount of chips for use in the live gaming tournament, wherein each one of the second plurality of contestants start the live gaming tournament with only the second amount of chips.

12. The system of claim 8, wherein the host unit further includes a transaction unit configured to:

elicit and receive, from at least one of the first plurality of contestants, payment to purchase virtual chips for use in the virtual gaming tournament, and electronically deliver the purchased virtual chips to the at least one of the first plurality of contestants based on the received payment.

13. The system of claim 8, wherein the virtual gaming tournament is conducted in a survival-mode format, wherein formation of the second plurality of contestants includes selection, by the selection module, of contestants of the first plurality of contestants that have survived after a predetermined number of the first plurality of contestants have been eliminated.

14. A non-transitory computer-readable medium having instructions stored thereon for causing a suitably programmed computer to execute a method, the method comprising:

eliciting and receiving a plurality of customers to a gaming website controlled by a computer system;

selecting, using the computer, a first plurality of contestants from the plurality of customers for participation in a virtual gaming tournament;

conducting, using the computer, the virtual gaming tournament, wherein each one of the first plurality of contestants play in the virtual gaming tournament using a device operatively coupled to the computer via an internet connection, and wherein no prizes are awarded in relation to the conducting of the virtual gaming tournament; and selecting, using the computer, a subset of the first plurality of contestants to form a second plurality of contestants, wherein the second plurality of contestants qualifies for entry to a live gaming tournament to be held at a physical location amongst only those contestants physically present in the physical location at a start of the live gaming tournament, and wherein the selecting of the subset of the first plurality of contestants is based at least in part on performance of the first plurality of contestants in the virtual gaming tournament, wherein prizes are awarded to a subset of the second plurality of contestants in the live gaming tournament based at least in part on performance of the second plurality of contestants in the live gaming tournament.

15. The non-transitory computer-readable medium of claim 14, further comprising instructions such that the method further includes providing each one of the first plurality of contestants a complimentary first amount of virtual chips for use in the virtual gaming tournament.

16. The non-transitory computer-readable medium of claim 14, further comprising instructions such that the method further includes:

eliciting and receiving, from at least one of the first plurality of contestants and into the computer system, payment for purchasing virtual chips for use in the virtual gaming tournament; and electronically delivering, using the computer system, the purchased virtual chips to the at least one of the first plurality of contestants based on the received payment.

17. The non-transitory computer-readable medium of claim 14, further comprising instructions such that the conducting of the virtual gaming tournament includes instituting a survival-mode format for the virtual gaming tournament, wherein the selecting includes choosing contestants of the first plurality of contestants that have survived after a predetermined number of the first plurality of contestants have been eliminated.

18. The non-transitory computer-readable medium of claim 14, further comprising instructions such that the virtual gaming tournament includes a time limit, and wherein the selecting includes choosing contestants of the first plurality of contestants that are in a top ten percent of the first plurality of contestants in terms of virtual chips accumulated within the time limit of the virtual gaming tournament.

19. The method of claim 1, wherein the virtual gaming tournament is a selected from the group consisting of a virtual poker tournament, a virtual craps tournament, a virtual baccarat tournament, a virtual roulette tournament and a virtual blackjack tournament, and further wherein the live gaming tournament is selected from the group consisting of a live poker tournament, a live craps tournament, a live baccarat tournament, a live roulette tournament and a live blackjack tournament.

20. The method of claim 19, wherein the virtual gaming tournament is a virtual poker tournament, and further wherein the live gaming tournament is a live poker tournament.

* * * * *